US010508509B2

(12) United States Patent
Orban

(10) Patent No.: US 10,508,509 B2
(45) Date of Patent: Dec. 17, 2019

(54) DEVICES FOR CONTINUOUS MUD-CIRCULATION DRILLING SYSTEMS

(71) Applicant: SCHLUMBERGER TECHNOLOGY CORPORATON, Sugar Land, TX (US)

(72) Inventor: Jacques Orban, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 164 days.

(21) Appl. No.: 15/241,532

(22) Filed: Aug. 19, 2016

(65) Prior Publication Data

US 2017/0159383 A1 Jun. 8, 2017

Related U.S. Application Data

(60) Provisional application No. 62/264,487, filed on Dec. 8, 2015.

(51) Int. Cl.

| | |
|---|---|
| ***E21B 19/16*** | (2006.01) |
| ***E21B 21/08*** | (2006.01) |
| ***E21B 33/08*** | (2006.01) |

(52) U.S. Cl.

CPC ..... *E21B 21/08* (2013.01); *E21B 19/165* (2013.01); *E21B 33/085* (2013.01)

(58) Field of Classification Search

CPC ..... E21B 21/08; E21B 19/165
USPC ..... 175/57
See application file for complete search history.

(56) References Cited

U.S. PATENT DOCUMENTS

| | | | | |
|---|---|---|---|---|
| 3,822,902 | A | 7/1974 | Maurer et al. | |
| 5,212,885 | A | 5/1993 | Buonodono et al. | |
| 6,591,916 | B1 * | 7/2003 | Ayling | E21B 19/16 166/380 |
| 6,803,757 | B2 | 10/2004 | Slates | |
| 8,511,389 | B2 | 8/2013 | Fenton | |
| 2002/0157838 | A1 | 10/2002 | Ayling | |
| 2004/0174163 | A1 | 9/2004 | Rogers et al. | |
| 2007/0017682 | A1 | 1/2007 | Abrahamsen et al. | |
| 2007/0240875 | A1 | 10/2007 | Van Riet et al. | |
| 2009/0151934 | A1 | 6/2009 | Heidecke et al. | |
| 2011/0174500 | A1 | 7/2011 | Davies et al. | |

(Continued)

FOREIGN PATENT DOCUMENTS

WO 2002036928 A1 5/2002

*Primary Examiner* — Taras P Bemko
(74) *Attorney, Agent, or Firm* — Rachel E. Greene

(57) ABSTRACT

A system and method for continuous mud circulation during a drilling operation, of which the method includes delivering a first flow of drilling mud to and through a blowout preventer via a drill string and a wellbore. The method also includes delivering a second flow of drilling mud to and through the blowout preventer. The second flow is delivered to the blowout preventer through an alternative line and not via the drill string. The method also includes stopping the first flow of the drilling mud, and adding or removing a tubular to or from the drill string after the first flow of drilling mud is stopped and while continuously delivering the second flow of drilling mud. Adding or removing the tubular includes decoupling a rotating control device from the blowout preventer, detachably coupling the rotating control device with a drag device, and raising or lowering the rotating control device with the drag device coupled therewith.

9 Claims, 12 Drawing Sheets

(56) References Cited

U.S. PATENT DOCUMENTS

| | | | | |
|---|---|---|---|---|
| 2013/0283917 | A1 | 10/2013 | Coonrod et al. | |
| 2014/0124267 | A1 | 5/2014 | Ayling | |
| 2014/0202767 | A1 | 7/2014 | Feasey | |
| 2014/0231073 | A1 | 8/2014 | Teodorescu et al. | |
| 2014/0262510 | A1 | 9/2014 | Beddoes et al. | |
| 2015/0191977 | A1* | 7/2015 | Skjaerseth ..... | E21B 19/16<br>175/218 |
| 2016/0002984 | A1 | 1/2016 | Grice | |

* cited by examiner

DEVICES FOR CONTINUOUS MUD-CIRCULATION DRILLING SYSTEMS

CROSS-REFERENCE TO RELATED APPLICATIONS

This application claims priority to U.S. Provisional Patent Application Ser. No. 62/264,487, which was filed on Dec. 8, 2015 and is incorporated herein by reference in its entirety.

BACKGROUND

During drilling operations, drilling fluid (e.g., drilling mud) may be pumped into a wellbore. When flowing upwards in an annulus defined between the drill string and the wellbore, the drilling mud may remove drill cuttings, reduce friction, etc., which may facilitate the drilling process. Also, depending on pressure distribution between the wellbore and the formation, the drilling mud may be loaded with formation fluids such as water, oil, and gas produced by some formations.

The drilling mud may be delivered into the wellbore through the drill string. The drill string may be rotatable, so as to rotate the drill bit, for at least a portion of the drilling operations. The drilling mud may also be used to power a mud motor within the drill string, which may be employed to provide rotation of the distal portion of the drill string. In many drilling systems, the delivery conduit for the drilling mud may be coupled to an interior of the drill string through a top drive.

During the drilling process, some connections at the top of the drill string may be broken, to add or remove drill string tubulars or pipes. For example, when drilling a new well, one or more tubulars may be added or "tripped in" when the top drive reaches the rig floor. To accomplish this, a connection between the drill string and the top drive may be broken to allow an additional tubular to be tripped in. Conversely, when a tubular is removed or "tripped out," the opposite process is performed. For example, as each tubular is removed from the drill string, a connection at a distal end of the tubular may be broken to allow the removal of the tubular from the drill string.

When the connection between two tubulars or between the top drive and a tubular is broken during tripping in or tripping out operations, the flow of the drilling mud generally ceases. As the flow if the drilling mud ceases, however, the total pressure of the wellbore may be lowered and formation fluids may enter the wellbore. The infiltration of the formation fluids (such as gas, or liquid hydrocarbon) into the wellbore may create hazards (e.g., risk of fire or explosion at the surface) and may also affect wellbore stability. Further, the drill cuttings may settle in the annulus between the drill string and the wellbore, thereby increasing the risk of stuck-pipe. Additionally, a filter cake at the bore wall may allow the infiltration of some formations, which may reduce productivity along the reservoir and create a risk for wellbore instability. In addition, the ceasing of the drilling mud through the drill string may increase the volume of gas in the well-bore as the wellbore pressure may temporarily be lowered.

SUMMARY

Embodiments of the disclosure may provide a method for continuous mud circulation during a drilling operation. The method includes delivering a first flow of drilling mud to and through a blowout preventer via a drill string and a wellbore, and delivering a second flow of drilling mud to and through the blowout preventer. The second flow is delivered to the blowout preventer through an alternative line and not via the drill string. The method also includes stopping the first flow of the drilling mud, and adding or removing a tubular to or from the drill string after the first flow of drilling mud is stopped and while continuously delivering the second flow of drilling mud. Adding or removing the tubular includes decoupling a rotating control device from the blowout preventer, detachably coupling the rotating control device with a drag device, and raising or lowering the rotating control device with the drag device coupled therewith.

In some embodiments, detachably coupling the rotating control device with the drag device includes detachably coupling a finger of the drag device with the rotating control device.

In some embodiments, detachably coupling the finger with the rotating control device includes moving the finger laterally toward the rotating control device.

In some embodiments, moving the finger includes applying a biasing force to the finger using a piston configured to receive hydraulic fluid.

In some embodiments, raising or lowering the rotating control device with the drag device coupled therewith includes moving the drag device along a vertical guide.

In some embodiments, the drag device is moved along the vertical guide using a winch coupled with the drag device via a cable.

In some embodiments, adding the tubular to the drill string includes raising the rotating control device above a rig floor, sealingly engaging the rotating control device with the tubular above the rig floor, and lowering the rotating control device toward the rig floor using the drag device. The rotating control device is detachably coupled with the drag device above the rig floor.

In some embodiments, the rotating control device sealingly engages the tubular proximal to a lower connection thereof after being lowered using the drag device.

In some embodiments, adding the tubular further includes decoupling the drag device from the rotating control device, positioning the tubular and the rotating control device below the rig floor after decoupling the drag device from the rotating control device, and coupling the rotating control device with the blowout preventer.

In some embodiments, removing the tubular from the drill string includes sealingly engaging the rotating control device with the tubular coupled with the drill string before decoupling the rotating control device from the blowout preventer, positioning a connection between the tubular and the drill string between the rotating control device and a tubular lock of the blowout preventer, engaging the tubular lock to supporting the drill string in the wellbore, engaging a pipe ram to seal an annulus defined between the blowout preventer and the drill string, and breaking a connection between the tubular and the drill string.

In some embodiments, removing the tubular from the drill string further includes engaging an annular seal of the blowout preventer before decoupling the rotating control device from the blowout preventer. A lower end of the tubular is moved between the annular seal and the rotating control device prior to engaging the annular seal.

In some embodiments, the rotating control device at least partially defines a first chamber, and the blowout preventer at least partially defines a second chamber.

In some embodiments, the method further includes preventing fluid communication between the first chamber and the second chamber while delivering the second flow of drilling mud.

In some embodiments, preventing fluid communication between the first chamber and the second chamber comprises engaging an annular seal of the blowout preventer.

In some embodiments, the method further includes directing the first flow of drilling mud to the second chamber of the blowout preventer, and directing the first flow of drilling mud from the second chamber.

Embodiments of the disclosure may also provide a system for a drilling operation. The system includes a blowout preventer configured to be disposed above a wellbore and receive a drill string therethrough, a rotating control device configured to be detachably coupled with the blowout preventer, and further configured to receive and sealingly engage a tubular of the drill string, a drag device configured to be detachably coupled with the rotating control device when the rotating control device is decoupled from the blowout preventer, and further configured to raise and lower the rotating control device, and a drilling device in fluid communication with an inner bore of the drill string and configured to at least partially raise and lower the drill string through the blowout preventer and the rotating control device.

In some embodiments, the rotating control device includes a slide seal configured to be disposed radially outward of the tubular, and further configured to sealingly engage the tubular, and a seal retainer disposed radially outward of the slide seal and defining an annular slot configured to be detachably coupled with the drag device.

In some embodiments, the rotating control device further includes a rotating body coupled with the seal retainer, and a non-rotating body disposed radially outward of and rotatably coupled with the rotating body.

In some embodiments, the drag device is configured to raise and lower the rotating control device above a rig floor and along a vertical guide.

In some embodiments, the drag device includes a drag body defining a through-hole and a chamber, the through-hole configured to receive the vertical guide, and a finger assembly slidably disposed in the chamber and configured to engage and detachably couple with the rotating control device.

The foregoing summary is intended merely to introduce a subset of the aspects of the disclosure, which may be further described below. This summary is not intended to be exhaustive or to limit the scope of the disclosure presented below or recited in the appended claims.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
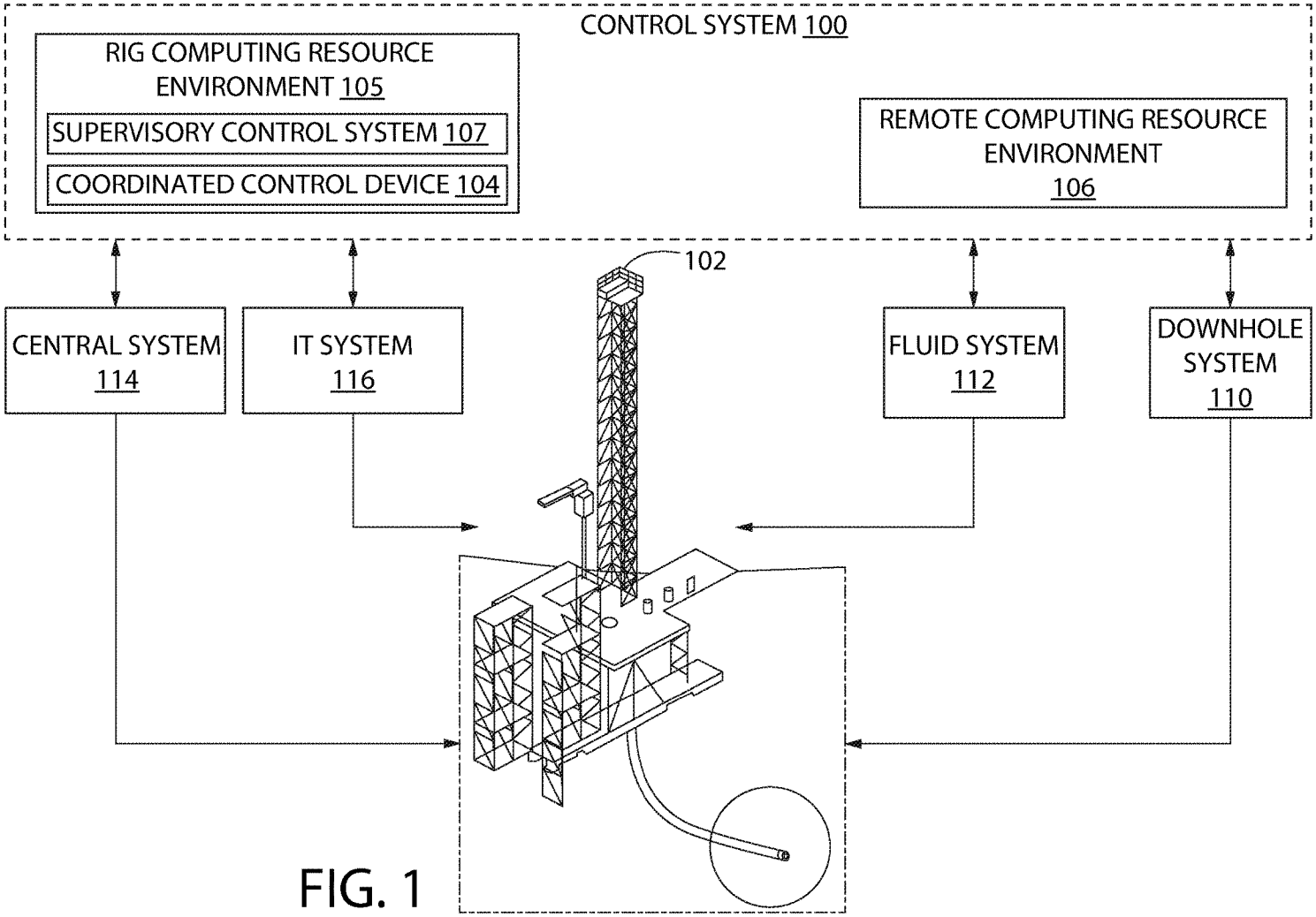
FIG. 1 illustrates a schematic view of a drilling rig and a control system, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottom-hole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
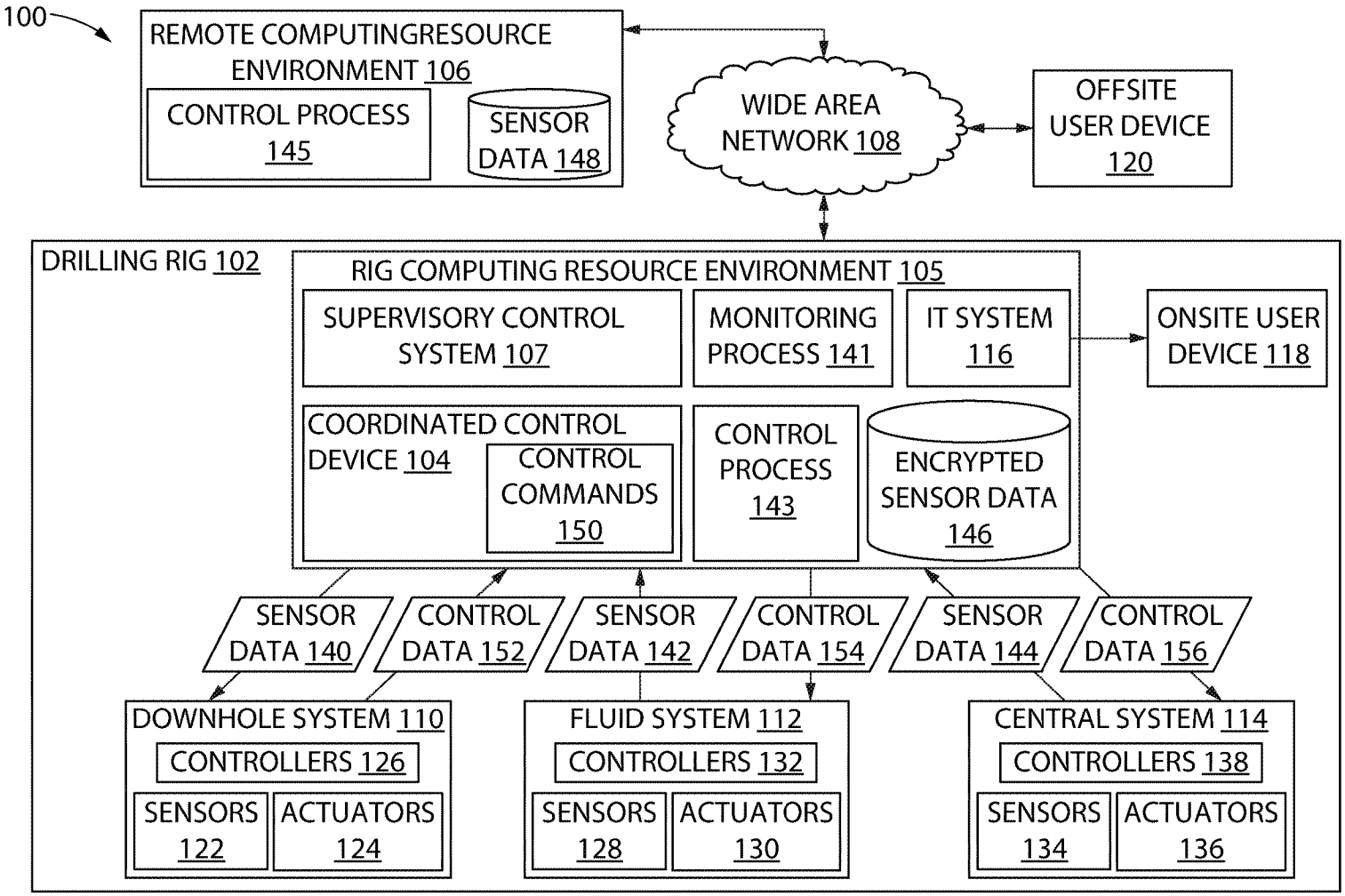
FIG. 2 illustrates a schematic view of a drilling rig and a remote computing resource environment, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Figure 3A:
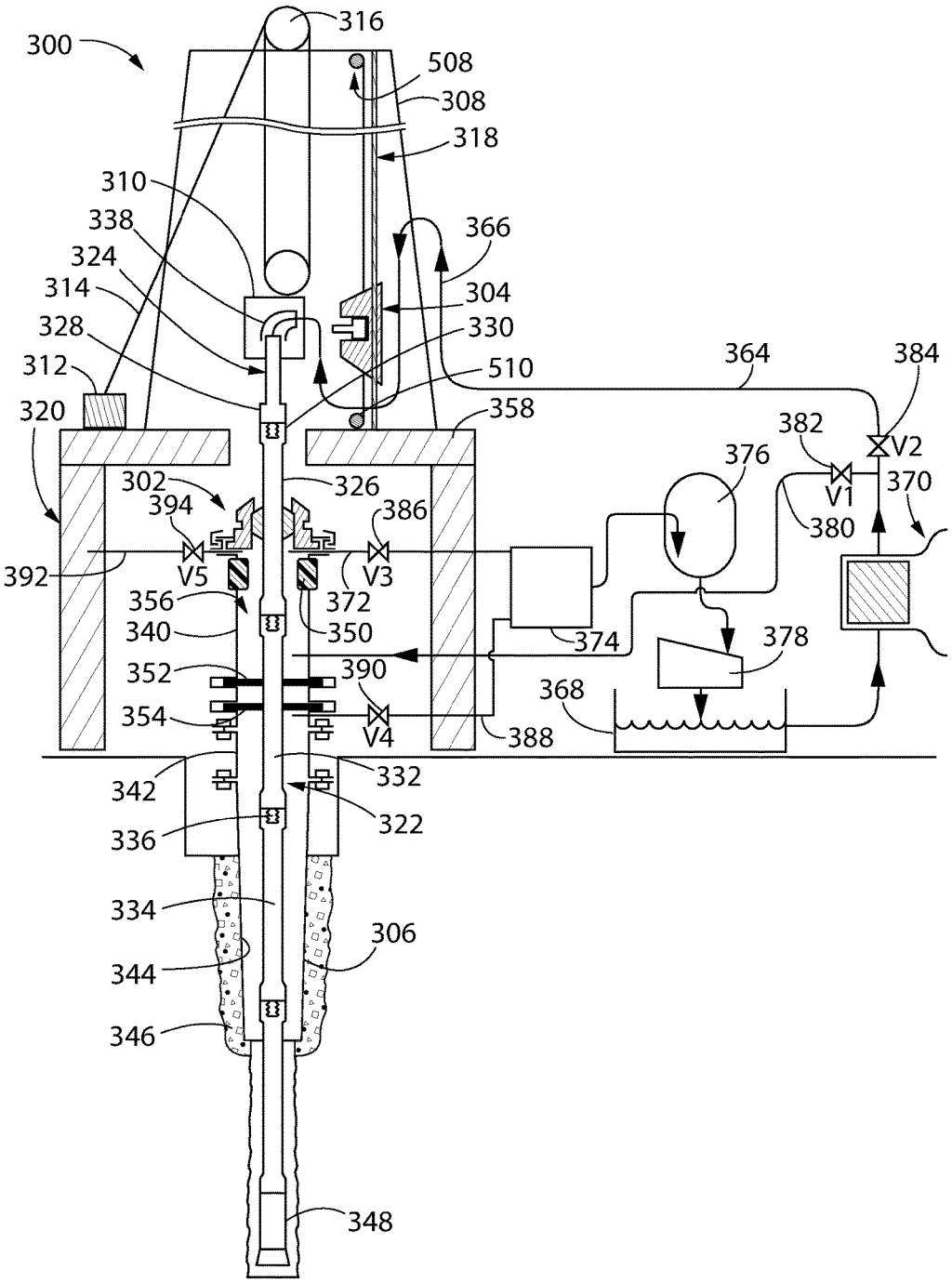
FIGS. 3A, 3B, and 3C illustrate schematic views of a drilling system including a rotating control device ("RCD") and a drag device, according to an embodiment.
Figure 3B:
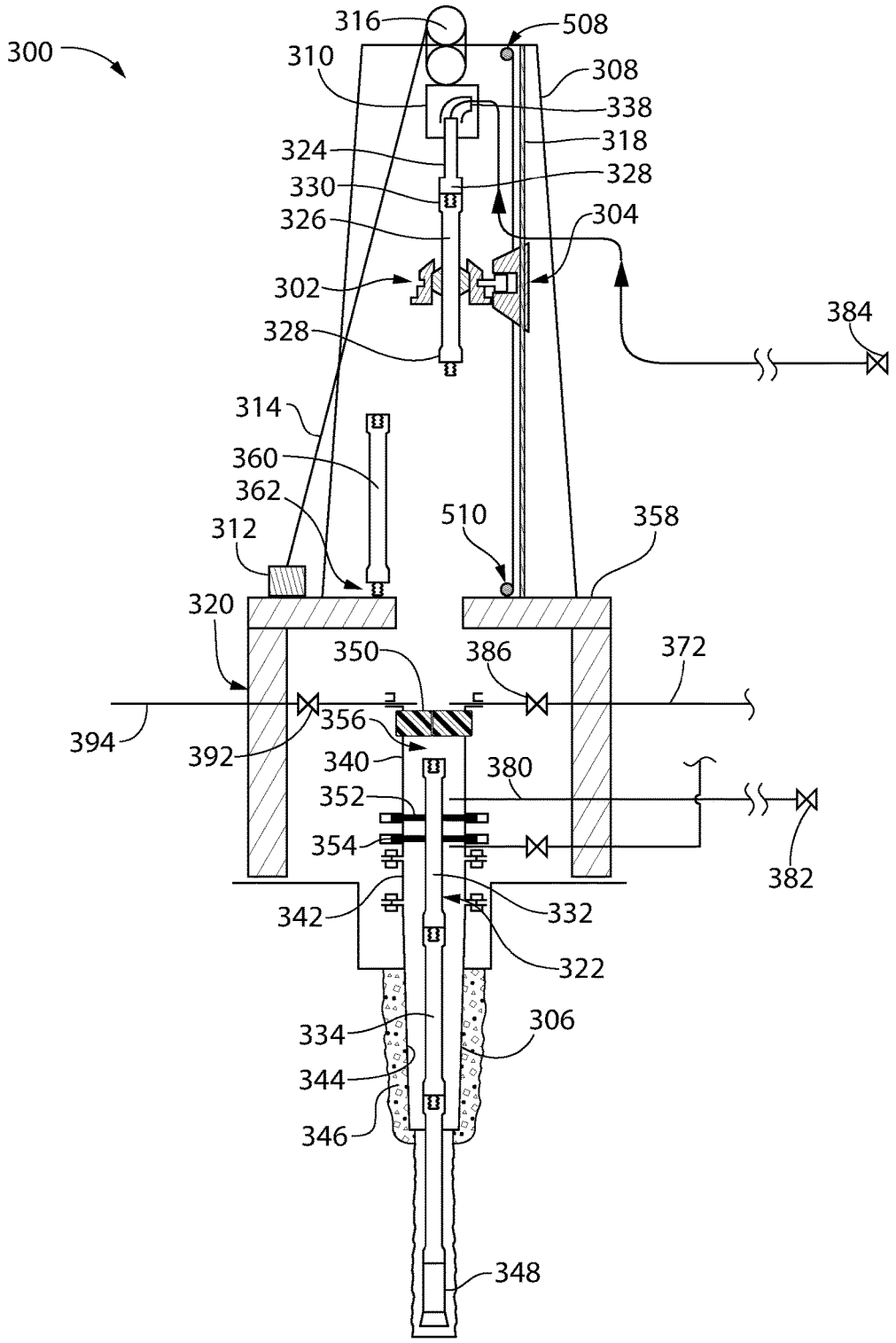
Figure 3C:
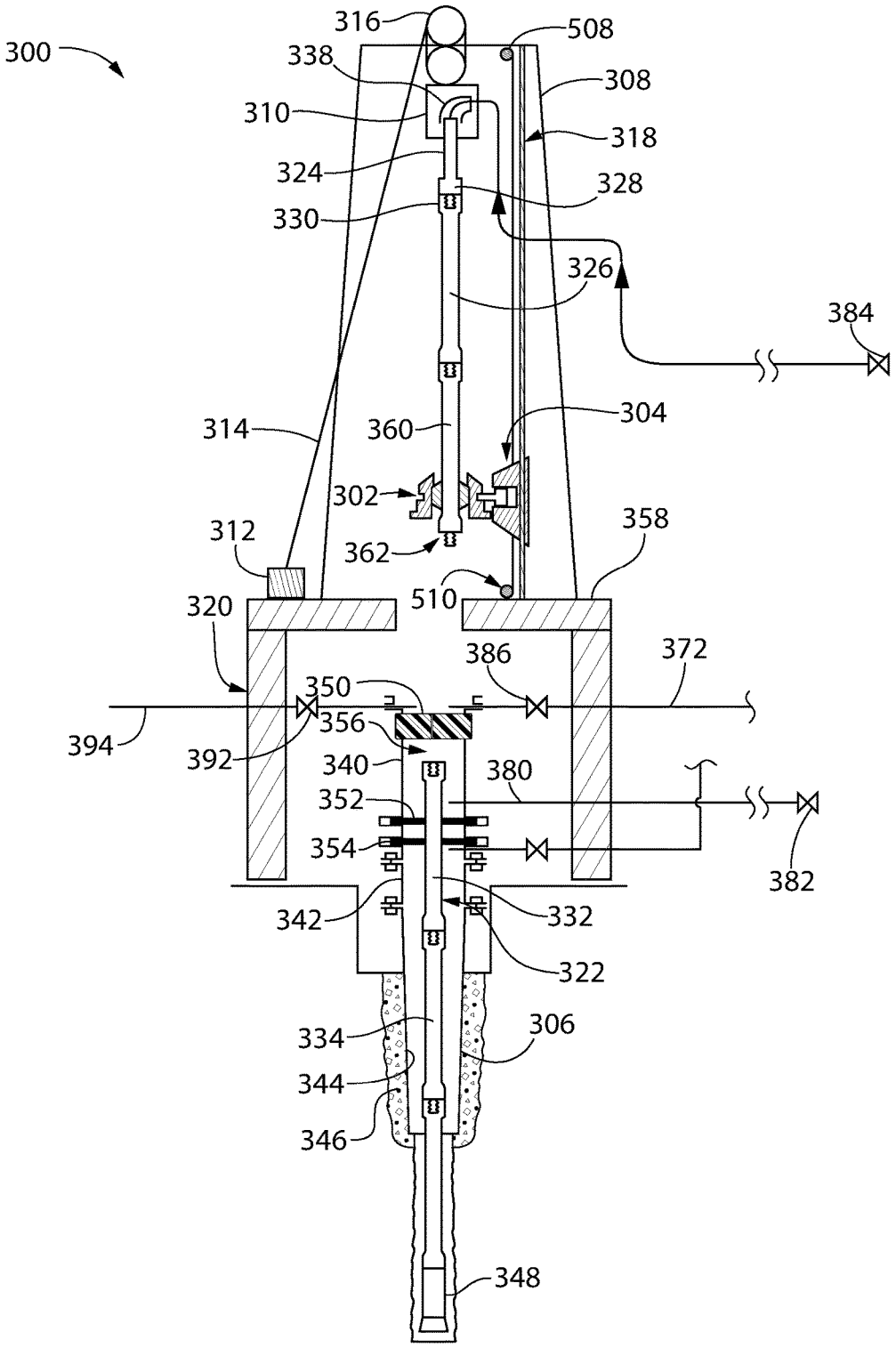

FIGS. 3A-3C illustrate schematic views of a drilling system 300 including a rotary control device ("RCD") 302 and a drag device 304, according to an embodiment. As illustrated in FIGS. 3A-3C, the drilling system 300 may be located partially above and partially within a wellbore 306 (e.g., after drilling operations have commenced). The drilling system 300 may include a mast 308 from which a top drive 310 (or another tubular-rotating and/or tubular-supporting, drilling device) may be movably supported. For example, the top drive 310 may be raised and lowered along the mast 308 using a drawworks 312 coupled to the top drive 310 via a drilling line 314 received through a set of sheaves 316. The drilling system 300 may also include a vertical guide 318, which may be, for example, coupled with the mast 308 and configured to direct the drag device 304 along the mast 308.

The drilling system 300 may also include a rig substructure 320 that may support the mast 308 and structures or components coupled therewith. The rig substructure 320 may straddle the wellbore 306. A drill string 322 may be received through an opening in a rig floor 358 of the rig substructure 320 and may extend into the wellbore 306. The drill string 322 may be supported by the top drive 310, e.g., via a connection with a shaft or "quill" 324 that is rotated by the top drive 310. In at least one embodiment, illustrated in FIGS. 3A-3C, the shaft 324 may include a shaft extension 326 coupled with a neck 328 of the shaft 324. Accordingly, the shaft 324 may be coupled with a box-end connection 330 of the shaft extension 326, and the shaft extension 326 may be coupled with a tubular 332 (e.g., the upper-most tubular) of the drill string 322. In another embodiment, the shaft 324 may not include the shaft extension 326, and the shaft 324 may be directly coupled with the tubular 332 of the drill string 322. As illustrated in FIG. 3A, the upper-most tubular 332 may be coupled with a next tubular 334 at a connection 336.

The top drive 310 may be fluidly coupled with a mud supply line 364, which may include a standpipe 366. For example, the mud supply line 364 may be fluidly coupled with an interior of the shaft 324 via a conduit 338 disposed within the top drive 310. The top drive 310 may rotate the shaft 324 and a rotary seal (not shown) disposed between the conduit 338 and the shaft 324. The rotary seal may retain the pumped fluid inside a bore of the conduit 338 and shaft 324.

The drill string 322 may extend or be received through the RCD 302, a blowout preventer ("BOP") 340, and a wellhead 342. As further described herein, the RCD 302 may be a mobile RCD configured to be detachably or releasably coupled with the BOP 340. The BOP 340 may be coupled with or otherwise disposed above (e.g., directly above) the wellhead 342. As illustrated in FIG. 3A, the BOP 340 may be disposed between the RCD 302 and the wellhead 342. As further illustrated in FIG. 3A, the drill string 322 may pass through the wellhead 342, and may extend into the wellbore 306, which may be partially cased with a casing 344 and/or cemented with a cement layer 346. The drill string 322 may extend to its distal terminus, where a bottom hole assembly ("BHA") 348 including a drill bit may be located.

The BOP 340 may include an elastomeric annular body or seal 350, which may be referred to as a BOP annular preventer or, more succinctly, a BOP annular. The BOP annular 350 may be configured to seal and unseal the BOP 340 and/or the wellhead 342. For example, the BOP annular 350 may be selectively opened to unseal or disengage the BOP 340 and/or the wellhead 342, as illustrated in FIG. 3A. Conversely, the BOP annular 350 may be selectively closed to seal or engage the BOP 340 and/or the wellhead 342, as illustrated in FIGS. 3B and 3C. The BOP 340 may also include a pipe ram 352 and a tubular lock 354. The tubular lock 354 may be operated in similar way as a pipe ram. When activated the tubular lock 354 may support the weight of the tubular passing through the BOP 340, including the weight of the drill string 322 connected thereto. The tubular lock 354 may also lock the tubular in rotation, allowing make-up torque to be applied to a new tubular to be added in the drill string 322, as well as un-torqueing an above tubular from the locked string 322.

The pipe ram 352 and/or the tubular lock 354 may be disposed below the BOP annular 350. In at least one embodiment, illustrated in FIG. 3A, the pipe ram 352 may be disposed above (e.g., vertically above) the tubular lock 354. In another embodiment, the tubular lock 354 may be disposed above the pipe ram 352. The pipe ram 352 may be configured to seal an annulus 356 defined between the BOP 340 and the drill string 322, and the tubular lock 354 may be configured to prevent the drill string 322 from rotating. For example, the tubular lock 354 may engage or interface with the drill string 322 to prevent the drill string 322 from rotating. The pipe ram 352 and/or the tubular lock 354 may be configured to support the weight of the drill string 322 within the wellbore 306.

Figure 4:
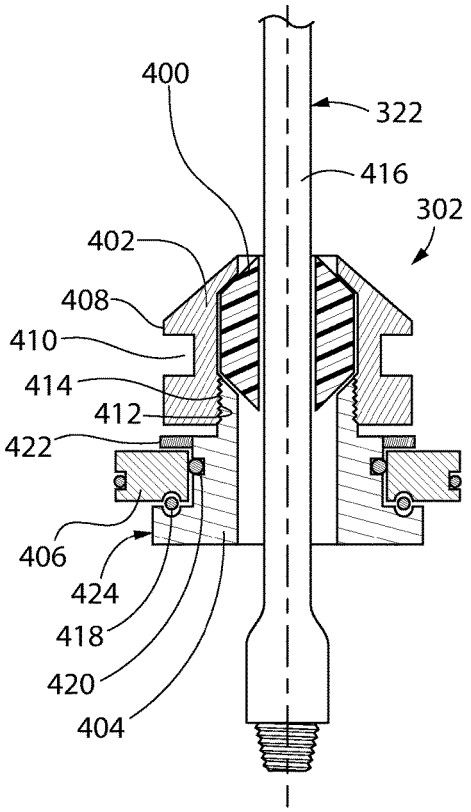
FIG. 4 illustrates a side, cross-sectional view of the RCD of FIGS. 3A-3C, according to an embodiment.

FIG. 4 illustrates a side, cross-sectional view of the mobile RCD 302 of FIGS. 3A-3C, according to an embodiment. The RCD 302 may generally include a slide seal 400 disposed radially outward of the drill string 322, a seal retainer 402, a rotating body 404, and a non-rotating body 406. The RCD 302 may be configured to receive at least a portion or section of the drill string 322. For example, the slide seal 400 of the RCD 302 may be configured to receive the shaft extension and/or a tubular 416 of the drill string 322. The RCD 302 and the slide seal 400 thereof may be mobile, or movable, along the drill string 322. The slide seal 400 may be compressed against the drill string 322 but may be configured to deform so as to slide above the extremities of the tubular 416, which may have a larger diameter than the main body of the tubular 416. The seal retainer 402 may be disposed radially outward of the slide seal 400, and may be fabricated from a material relatively more rigid than the slide seal 400. The seal retainer 402 may be configured to engage or mate with the drag device 304 (see FIGS. 3A and 5A). For example, as illustrated in FIG. 4, an outer radial surface 408 of the seal retainer 402 may define a finger slot 410 extending radially inward and configured receive or mate with the drag device 304 or one or more components thereof.

The rotating body 404 may be coupled or integrally formed with the seal retainer 402. For example, as illustrated in FIG. 4, the rotating body 404 may define meshing threads 412 along an outer radial surface thereof configured to mate with corresponding threads 414 defined along an inner radial surface of the seal retainer 402. During one or more modes of operating the drilling system 300, the rotating body 404, the slide seal 400, and the seal retainer 402 may be configured to rotate with the tubular 416. It will be appreciated that other attachment methods may be considered between the rotating body 404 and the retainer 402, such as flanges and bolts.

The non-rotating body 406 may be disposed radially outward of and rotatably coupled with the rotating body 404. For example, as illustrated in FIG. 4, the non-rotating body 406 may be rotatably coupled with the rotating body 404 via a thrust bearing 418 and/or a rotation seal 420. The RCD 302 may include a down-thrust lock 422 coupled or integrally formed with the rotating body 404 and configured to prevent the displacement (e.g., axial displacement) of the non-rotating body 406 relative to the rotating body 404. For example, as illustrated in FIG. 4, the down-thrust lock 422 may be coupled with the rotating body 404 such that the non-rotating body 406 may be interposed between the down-thrust lock 422 and a ledge or flange 424 of the rotating body 404.

Figure 5A:
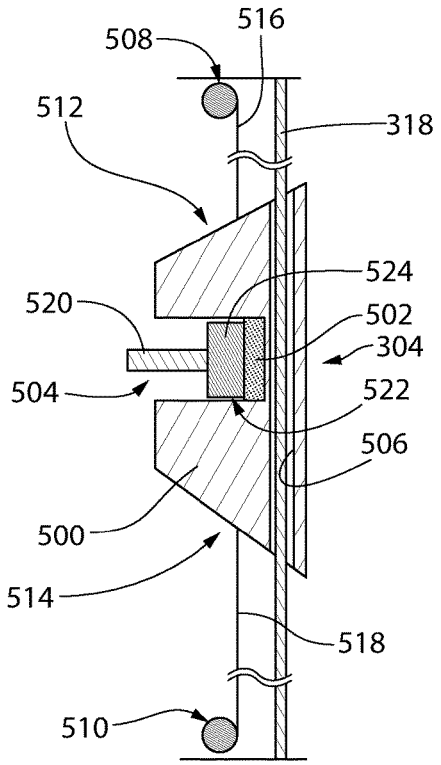
FIG. 5A illustrates a side, cross-sectional view of the drag device of FIGS. 3A-3C, according to an embodiment.

FIG. 5A illustrates a side, cross-sectional view of the drag device 304 of FIGS. 3A-3C, according to an embodiment. The drag device 304 may be coupled with the vertical guide 318 and configured to be moved or translated (e.g., up and down) along the vertical guide 318. The drag device 304 may also be configured to move with and/or apply a moving force to the RCD 302 (see FIG. 4) or a component thereof to position the RCD 302 at a chosen position above the rig floor 358 (see FIG. 3A). The drag device 304 may include a drag body 500 defining a chamber 502, and a finger assembly 504 at least partially disposed in the chamber 502. The drag body 500 may be configured to couple the drag device 304 with the vertical guide 318. For example, as illustrated in FIG. 5A, the drag body 500 may define a guide surface 506 configured to receive the vertical guide 318. The drag body 500 may also be configured to at least partially facilitate the movement of the drag device 304 along the vertical guide 318. For example, the drag body 500 may include one or more rollers (not shown) coupled therewith and configured to facilitate the movement of the drag device 304 along the vertical guide 318. In another example, the drag body 500 and/or one or more components thereof (e.g., the through-hole, the rollers, etc.) may be configured to limit or constrain lateral movement of the drag device 304 relative to the vertical guide 318.

The drag device 304 may be moved along the vertical guide 318 via any suitable device or assembly. For example, the drag device 304 may be moved along the vertical guide 318 via one or more screw or worm drives, rack and pinion assemblies, magnetic assemblies, gear assemblies, or the like. In another example, illustrated in FIG. 3A and further illustrated in detail in FIG. 5A, the drag device 304 may include one or more winches (two are shown 508, 510) configured to move the drag device 304 along the vertical guide 318. As illustrated in FIG. 3A, a first or upper winch 508 may be coupled with a crossbeam of the mast 308, and a second or lower winch 510 may be coupled with a rig floor 358 of the rig substructure 320. The upper winch 508 and the lower winch 510 may be coupled with an upper end portion 512 and a lower end portion 514 of the drag body 500, respectively, via respective cables 516, 518. Accordingly, the upper and/or lower winches 508, 510 may be actuated to raise and/or lower the drag device 304 along the vertical guide 318.

The finger assembly 504 may include a finger 520 and a finger pusher 522 at least partially disposed in the chamber 502 of the drag body 500. In at least one embodiment, illustrated in FIG. 5A, the finger 520 may be coupled with the finger pusher 522. In another embodiment, the finger 520 may be integrally formed with the finger pusher 522. The finger pusher 522 may be configured to slide the finger 520 within and/or into and out of the chamber 502. For example, the finger pusher 522 may be or include one or more pistons (one is shown 524) configured to control a radial or lateral position of the finger 520. In at least one embodiment, the piston 524 may form a fluid tight seal with chamber 502. For example, the piston 524 may define one or more circumferential channels (not shown) having one or more seals (e.g., O-rings) (not shown) at least partially disposed therein and configured to provide a fluid tight seal between the piston 524 and the chamber 502. In addition to, or in substitution of the seals, one or more guiding rings (not shown) may be disposed in the channels and configured to maintain the orientation of the piston 524 within the chamber 502.

The chamber 502 may be configured to receive a fluid (e.g., a hydraulic fluid, an oil, etc.) to apply or exert a biasing force or load to the piston 524 slidably disposed therein. For example, the chamber 502 may be fluidly coupled with an accumulator (not shown) configured to direct the hydraulic fluid to the chamber 502 to apply the biasing force to the piston 524. The biasing force may actuate the piston 524 and the finger 520 coupled therewith in a lateral direction. The finger pusher 522 or the piston 524 thereof may actuate the finger 520 laterally toward the RCD 302 (see FIGS. 3A and 4). The fingers 520 and the piston 524 may be activated by other devices such as electrical motor associated with a screw.

Figure 5B:
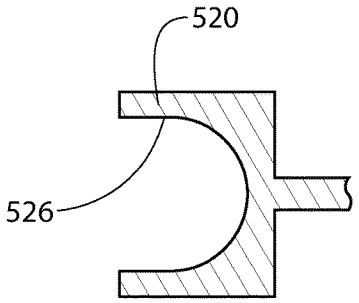
FIG. 5B illustrates a plan view of a finger of the drag device of FIG. 5A, according to an embodiment.

Accordingly, the finger 520 may be configured (e.g., shaped) to engage or mate with the RCD 302 and one or more components thereof. For example, as illustrated in FIG. 5B, the finger 520 may define a generally semicircular cavity 526 configured to mate with the finger slot 410 of the RCD 302 (see FIG. 4).

Figure 6:
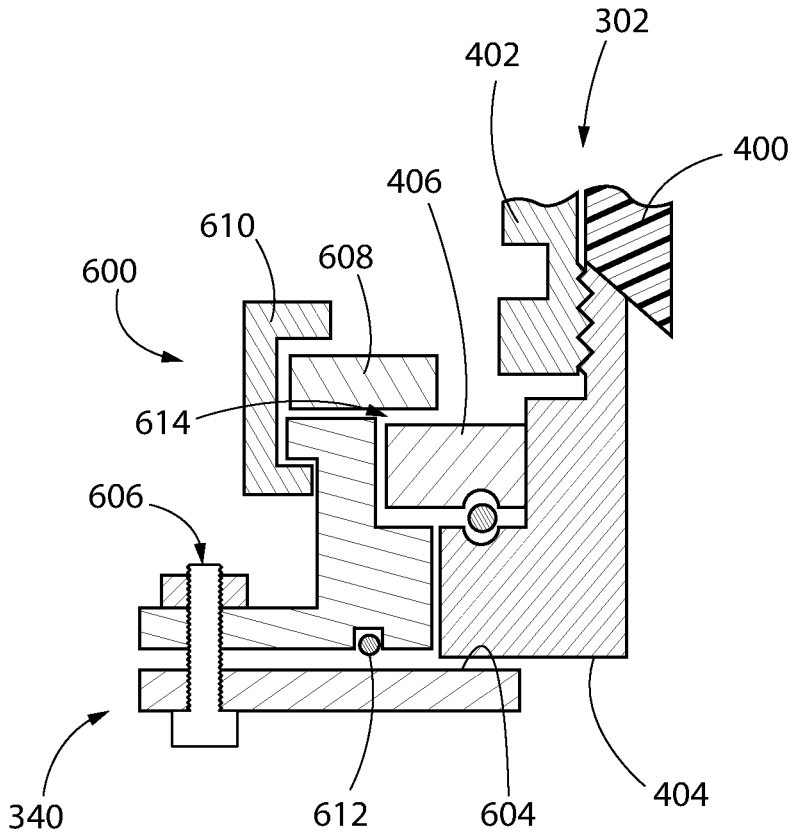
FIG. 6 illustrates a side, cross-sectional view of an interface between the RCD and the BOP, according to an embodiment.

FIG. 6 illustrates a side, cross-sectional view of an interface between the RCD 302 and the BOP 340, according to an embodiment. The RCD 302 and the BOP 340 may be coupled with one another at the interface thereof. For example, as illustrated in FIG. 6, the RCD 302 and the BOP 340 may be coupled with one another via a coupling assembly 600. The coupling assembly 600 may include a coupling body 602 disposed above a top or upper surface 604 of the BOP 340, and a retaining ring 608 disposed above the coupling body 602. The coupling body 602 may be fastened to the upper surface 604 of the BOP 340. For example, as illustrated in FIG. 6, the body 602 may be coupled with the BOP 340 via one or more mechanical fasteners (one is shown 606). Illustrative mechanical fasteners may include, but are not limited to, one or more bolts, nuts, and/or any other suitable mechanical fasteners known in the art. In at least one embodiment, a seal 612 may be disposed between the coupling body 602 and the upper surface 604 of the BOP 340, and configured to provide a fluid tight seal therebetween.

As illustrated in FIG. 6, the retaining ring 608 and the body 602 may at least partially define an annular cavity 614 configured to receive at least a portion of the RCD 302. For example, the annular cavity 614 may be configured to receive the non-rotating body 406 of the RCD 302. As illustrated in FIG. 6, the retaining ring 608 may engage the non-rotating body 406 of the RCD 302 to retain the non-rotating body 406 within the annular cavity 614 to thereby couple the RCD 302 with the BOP 340. In at least one embodiment, illustrated in FIG. 6, the retaining ring 608 may retain the non-rotating body 406 in the annular cavity 614 with the aid of a locking ring 610 (e.g., split lock ring). Accordingly, the locking ring 610 may couple the retaining ring 608 to the body 602 to thereby retain the non-rotating body 406 of the RCD 302 in the annular cavity 614.

Referring back to FIG. 3A, during one or more modes of operating the drilling system 300, a fluid or slurry "drilling mud" may be directed into the wellbore 306 through the drill string 322. The drilling mud may be directed into the wellbore 306 to remove cuttings, maintain bottom hole pressure, reduce friction, etc. The drilling mud may be pumped from a pit or tank 368 to the conduit 338 via the mud supply line 364 with the aid of a pump 370. The drilling mud directed to the conduit 338 may flow to the BHA 348 disposed at the distal end of the wellbore 306 via the conduit 338 of the top drive 310, the drill string 322, and the BHA 348. The drilling mud may then circulate back up through the wellbore 306 via the wellhead 342, the BOP 340, and the RCD 302. The drilling mud in the RCD 302 may then be directed back to the pit or the tank 368 via a flow line 372. The flow line 372 may receive the drilling mud from the RCD 302 and deliver the drilling mud to a choke 374. The choke 374 may be utilized to manage pressure during drilling operations (e.g., as part of a managed pressure drilling operation). From the choke 374, the drilling mud may be delivered to a mud-gas separator ("MGS") 376, which may remove gases therefrom. From the MGS 376, the mud may be delivered to a shale shaker 378, which removes particulates therefrom, and finally may be delivered back to the mud pit 368. The flow of the drilling mud through the top drive 310, the drill string 322, and the wellbore 306, and out through the BOP 340 and the RCD 302 may be referred to as a primary flow path or a "first" flow of the drilling mud.

The drilling system 300 may also provide a secondary flow path through which a second flow of the drilling fluid may proceed. For example, in the illustrated embodiment, the drilling system 300 includes a second or "alternate" mud supply line 380, which may extend from the mud supply line 364 to the BOP 340, below the BOP annular 350. A first valve (V1) 382 may be disposed in the alternate mud supply line 380. When actuated to an opened position, the first valve 382 may divert at least a portion of the drilling mud from the mud supply line 364 to the BOP 340. Moreover, the mud supply line 364 may include a second valve (V2) 384, which may, for example, be closed to block mud flow to the top drive 310 via the mud supply line 364.

When using the alternate flow line 380, the tubular 326 may be disconnected from the drill string 334, and the BOP annular 350 may be closed. Similarly, the flow line 372 may include a third valve (V3) 386 configured to open and close, to allow and block, respectively, the flow of the drilling mud from the RCD 302 to the choke 374.

The drilling system 300 may also include a second or "alternate" flow line 388, which may extend from the BOP 340 to the choke 374. For example, as illustrated in FIGS. 3A-3C, the alternate flow line 388 may extend from a position below the pipe ram 352. The alternate flow line 388 may also include a fourth valve (V4) 390, which may open and close to allow and prevent, respectively, a flow of the drilling mud from the BOP 340 directly to the choke 374. The drilling system 300 may further include a bleed line 392, which may include a fifth valve (V5) 394 that is similarly operable with respect to the bleed line 392, and may be employed to relieve pressure in the RCD 302 when the BOP annular 350 is closed. In various embodiments, the bleed line 392 may be connected to the choke 374, the MGS 376, or the mud pit 368. The second flow of drilling mud may thus employ these alternate lines 380, 388, and may be delivered to and received directly from the BOP 340.

Figure 7A:
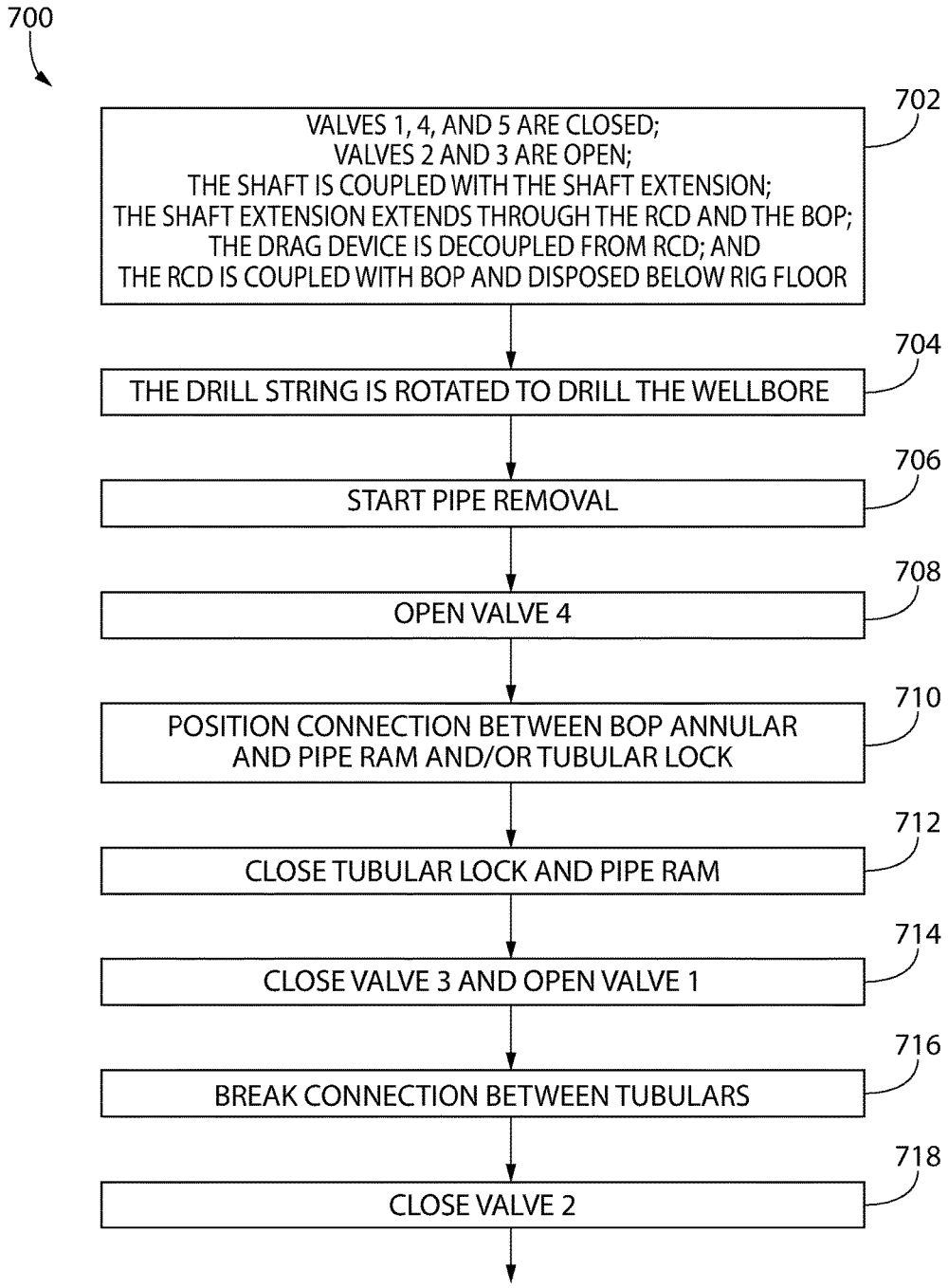
FIGS. 7A and 7B illustrate a flowchart of a method for continuous mud circulation during a drilling operation utilizing the RCD and the drag device, according to an embodiment.
Figure 7B:
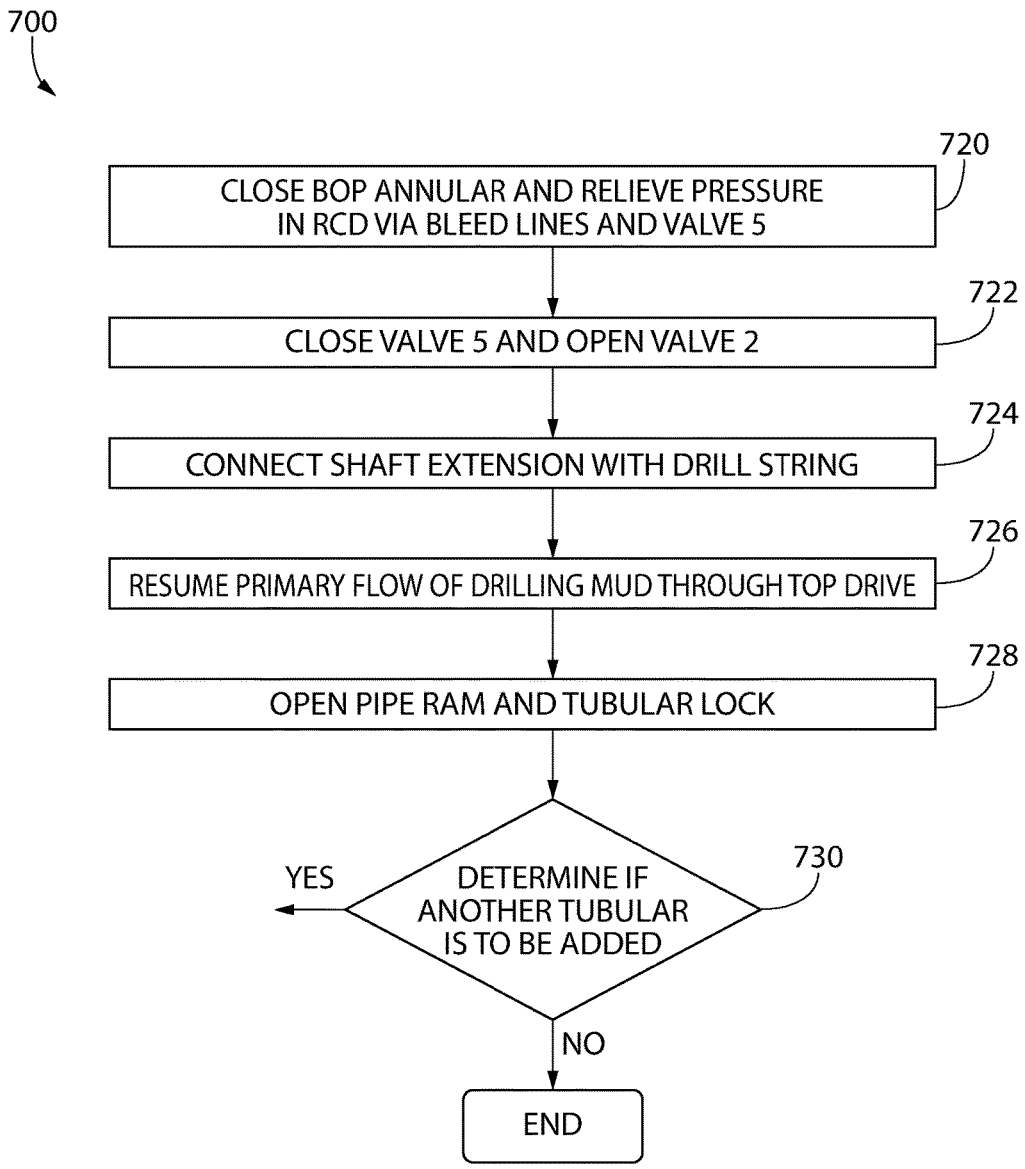
Figure 8A:
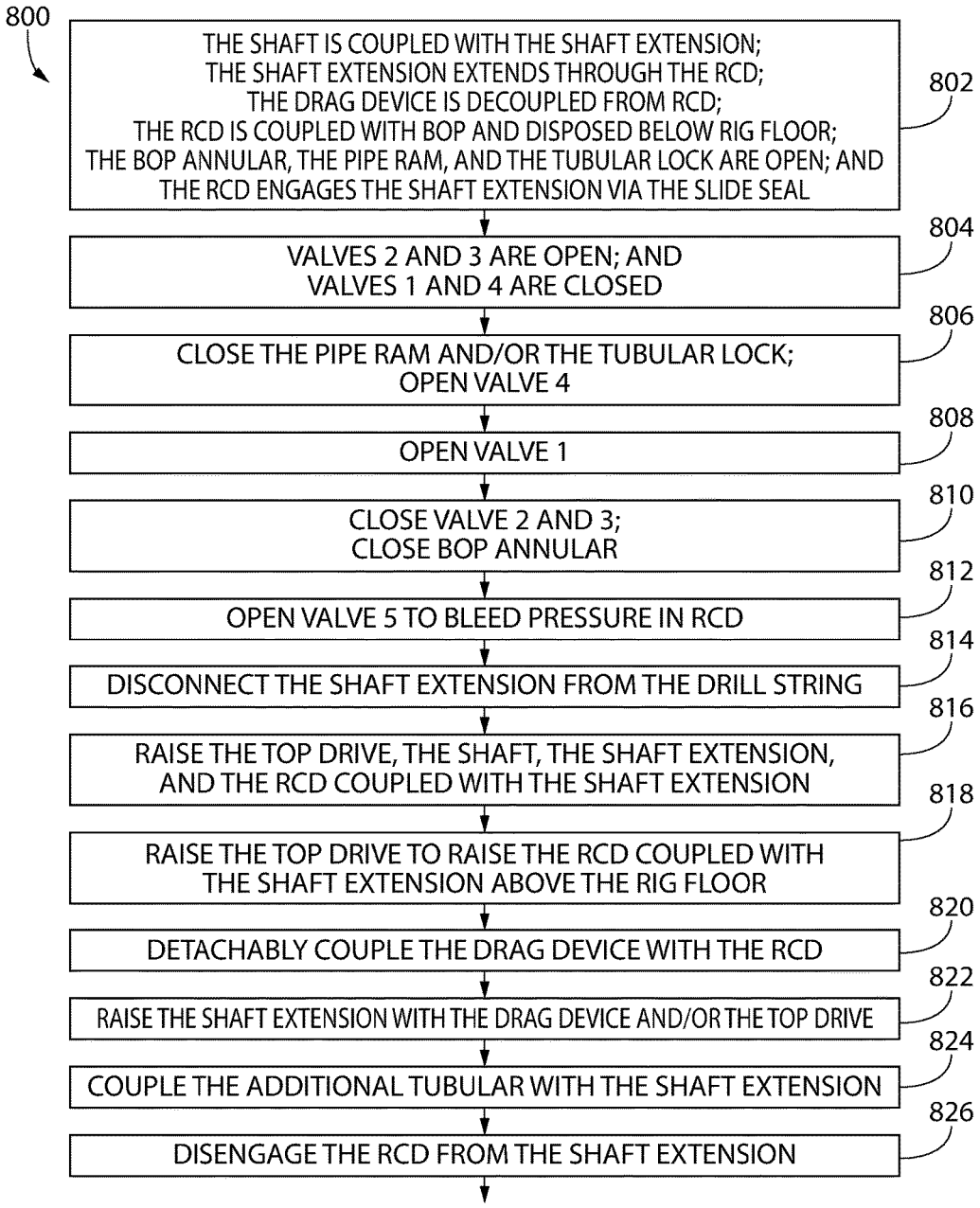
FIGS. 8A and 8B illustrate a flowchart of a method for continuous mud circulation during another drilling operation utilizing the RCD and the drag device, according to an embodiment.
Figure 8B:
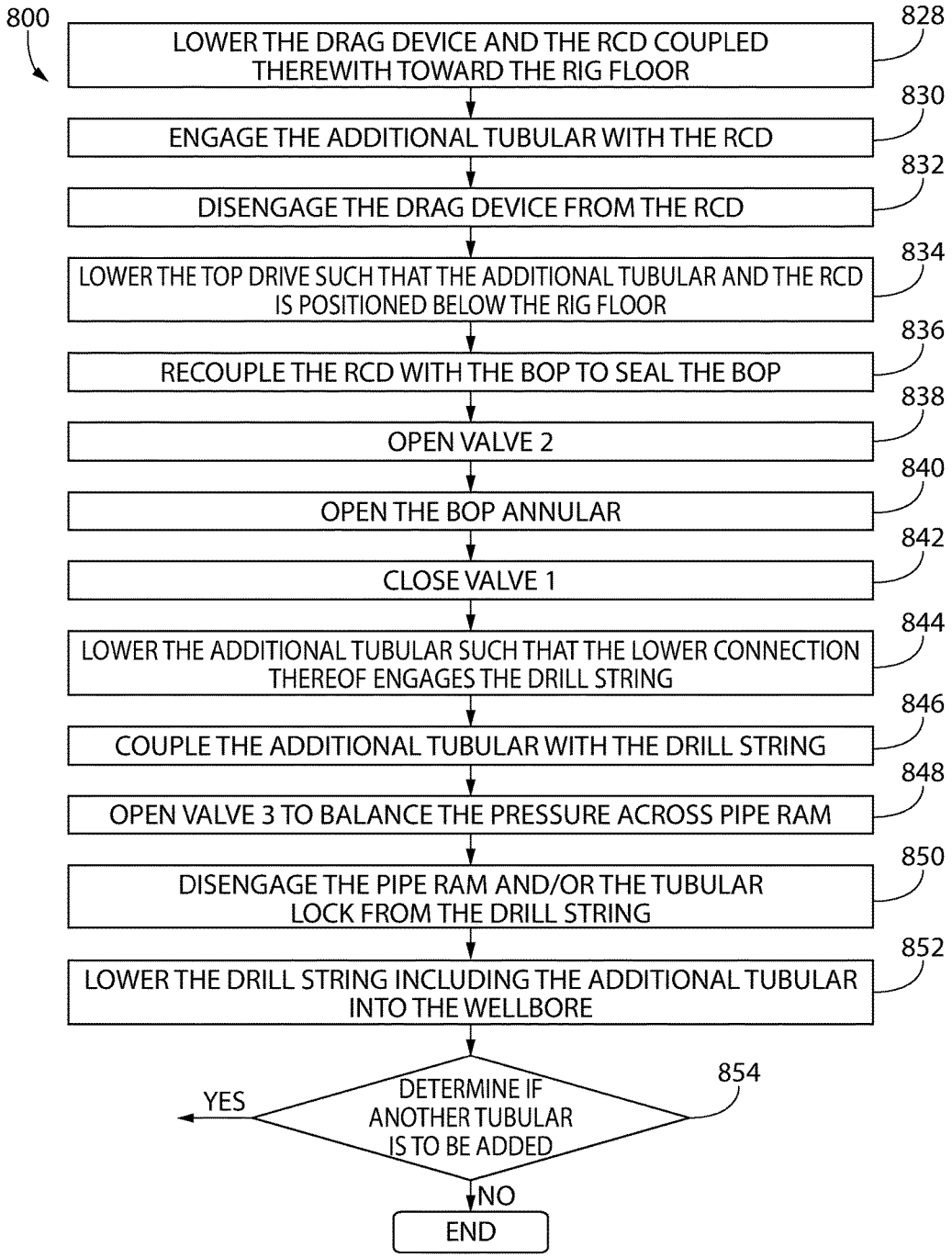

FIGS. 7A and 7B illustrate a flowchart of a method 700 for continuous mud circulation during a drilling operation utilizing the RCD 302 and the drag device 304, according to an embodiment. The flowchart illustrates the method 700 beginning in a "normal" drilling configuration, although this starting point is not to be considered limiting, as the method 700 may start in any suitable configuration of the system 300 (or another system).

In this instance, as indicated at 702, the first valve 382 may be closed, while the second valve 384 is open. As such, mud may be delivered from the mud pump 370 to the top drive 310 and downhole through the drill string 322. Further, the third valve 386 and the BOP annular 350 may be open, allowing mud circulated back through the wellhead 342 and the BOP 340 to be delivered to the choke 374 via the flow line 372. Further, the fourth and fifth valves 390 and 394 may be closed. That is, the first mud flow may be delivered to and received from the wellbore 306, while the second flow may be prevented. Additionally, as indicated at 702, the shaft or "quill" 324 of the top drive 310 may be coupled with the shaft extension 326, which may be coupled with the uppermost tubular 332 of the drill string 322. Further, the uppermost tubular 332 may extend through the RCD 302 and/or the BOP 340, and the drag device 304 may be decoupled or disengaged from the RCD 302. As further indicated at 702, the RCD 302 may be coupled with the BOP 340 and disposed below the rig floor 358. In this configuration, the method 700 may include rotating the drill string 722 to drill the wellbore 306, as at 704.

At some point, it may be desired to remove one or more tubulars of the drill string 322 from the wellbore 306, as indicated at 706. In such instances, the rotation of the drill string 322 may be stopped. Also, according to embodiments of the present method 700, when the drill string 322 is raised sufficiently, the shaft extension 326 may be disconnected from the uppermost tubular 332, and be removed from the drill string 322 while continuing to circulate mud downhole. To accomplish this, the method 700 may include opening the fourth valve 390, as at 708, which may open the alternate flow line 388, and directing some of the mud from the BOP 340 to the choke 374.

The method 700 may include positioning the connection 336 between the uppermost tubular 332 and the next tubular 334 between the BOP annular 350 and the pipe ram 352 and/or the tubular lock 354, as indicated at 710. The method 700 may then proceed to closing the tubular lock 354 and the pipe ram 352, as shown at 712. The pipe ram 352 and/or the tubular lock 354 may support the drill string 322 within the BOP 340 and below the rig floor 358. For example, the tubular lock 354 may hold the uppermost tubular 332 of the drill string 322 at least partially within the BOP 340 and prevent the tubular 332 from rotating, and the pipe ram 352 may generally provide a seal between the wellhead 342 and the BOP 340. Upon closing the pipe ram 352, the drilling mud may flow out or from the wellbore 306 to the choke 374 via the flow line 388 and the fourth valve 390.

As shown in 714, the method 700 may then include closing the third valve 386, and, e.g., thereafter, opening the first valve 382, to direct the flow of the drilling mud into the drill string 322 via the second or "alternate" path. It should be appreciated, however, that the drilling mud may still be provided to the drill string 322 via the primary flow path (e.g., via line 364). In particular, this may initiate mud flow through the alternate mud supply line 380, and stop the return flow of mud via the fourth valve 390 and the flow line 388.

The method 700 may also include disconnecting the uppermost tubular 332 from the next tubular 334 of the drill string 322 by breaking the connection 336, as indicated at 716. After breaking the connection 336, the remaining portions or tubulars of the drill string 322 may be supported by the tubular lock 354. In at least one embodiment, the top drive 310 may supply a torque sufficient to break out the connection 336 between the uppermost tubular 332 and the next tubular 334 of the drill string 322. In another embodiment, the drilling system 300 may utilize another device, assembly, or structure (e.g., tongs) to break the connection 336 between the uppermost tubular 332 and the next tubular 334 of the drill string 322. Breaking the connection 336 may allow for the initiation of the mud flow through the alternate mud supply line 380, while some mud flow may still be provided simultaneously by the mud supply line 364 (i.e., both the first and second mud flows may be at least partially active). The method 700 may include closing the second valve 384, as at 718, thereby stopping the first flow. Mud flow into the wellbore 306 may continue circulating via the alternate mud supply line 380 and the alternate flow line 388 (i.e., the second flow).

The method 700 may include closing the BOP annular 350 to seal the BOP 340 and/or the wellhead 342, as indicated at 720. After closing the BOP annular 350, pressure in the RCD 302 may be bled via the bleed line 392 and the fifth valve 394. The uppermost tubular 332 may then be moved upwards until its lower end (i.e., previously part of the connection 336) is pulled out of the RCD 302. The uppermost tubular 332 may then be disconnected or separated from the shaft extension 326 and/or the shaft 324, and removed from the drill string 322. After removing the uppermost tubular 332, the shaft extension 326 and/or the shaft 324 may be extended at least partially through the RCD 302.

The method 700 may also include closing the fifth valve 394 and opening the second valve 384 to equilibrate the pressure inside the RCD 302 with the pressure below the BOP annular 350, as indicated at 722. The BOP annular 350 may be opened and the first valve 382 may be closed. Closing the first valve 382 may prevent grease from washing away from a pin of the shaft extension 326 and/or the shaft 324. The method 700 may further include connecting the shaft extension 326 with the drill string 322, as shown at 724. The method 700 may also include resuming the first flow of mud through the top drive 310, as shown at 726. Make-up torque may be applied via the top drive 310 while reaction torque may be transmitted to the tubular lock 354. The method 700 may also include opening the pipe ram 352 and the tubular lock 354, as shown at 728. The method 700 may then include determining whether another joint is to be removed, as at 730. If another joint is to be removed, the method 700 may loop back to 706, and begin proceeding back through the subsequent blocks.

With continued reference to FIGS. 3A-3C, FIGS. 8A and 8B illustrate a flowchart of a method 800 for continuous mud circulation during a drilling operation utilizing the RCD 302 and the drag device 304, according to an embodiment. The drilling operation utilizing the RCD 302 and the drag device 304 may include connecting a tubular to the drill string 322. As illustrated in FIG. 3A and indicated at 802, the shaft or "quill" 324 of the top drive 310 may be coupled with the shaft extension 326, which may be coupled with the uppermost tubular 332 of the drill string 322. Accordingly, the drill string 322 may be supported by the top drive 310 when the drill string 322 is connected thereto via the shaft extension 326. Further, the shaft extension 326 may extend through the RCD 302, and the uppermost tubular 332 may extend into the BOP 340. Additionally, the drag device 304 may be decoupled or disengaged from the RCD 302. As further indicated at 802, the RCD 302 may be coupled with the BOP 340 and disposed below the rig floor 358. Additionally, as illustrated in FIG. 3A and shown at 802, the BOP annular 350, the pipe ram 352, and the tubular lock 354 may be open, and the RCD 302 may engage the shaft extension 326 via the slide seal 400 (see FIG. 4) to seal the wellbore 306. In this configuration, the drilling system 300 may rotate at least a portion of the drill string 322 to drill the wellbore 306. The drilling system 300 may also circulate the drilling mud into the wellbore 306 through the top drive 310 and the interior of the drill string 322. In such configuration, drilling may also proceed by turning the drill string 322, e.g., using the top drive 310, and allowing downward movement of the drill string 322 into the wellbore 306. When the wellbore 306 has been extended by the drilling process, the top of the shaft extension 326 is proximal to the rig floor 358. An additional tubular 360 may then be added in the drill string 322 in order to continue the drilling process.

The method 800 may include opening the second and third valves 384, 386 to allow the drilling mud to be directed from the pump 370 through the primary flow path (e.g., via lines 364 and 372), as shown at 804. As further shown at 804, the first and fourth valves 382, 390 may be closed to block or stop the flow of the drilling mud through the secondary flow path.

The pipe ram 352 and/or the tubular lock 354 may be engaged or closed, and the fourth valve 390 may be opened, as shown at 806 and illustrated in FIG. 3A. The method 800 may further include opening the first valve 382, as shown at 808. The drilling mud may be directed from the pump 370 to the drill string 322 via the primary flow path via lines 364 and 372, and the top drive 310, and via the secondary flow path via the mud supply line 380.

The method 800 may include closing the second valve 384, the third valve 386, and the BOP annular 350, as shown at 810. The drilling mud from the pump 370 may flow through the alternate mud supply line 380 and to the choke 374 via the flow line 388. Further, the fifth valve 394 may be opened to bleed the pressure inside the RCD 302 via the bleed line 392, as shown at 812. The method 800 may include disconnecting the shaft extension 326 from the drill string 322, as indicated at 814 and illustrated in FIG. 3B. The method 800 may also include raising the top drive 310 to thereby raise the shaft 324 and the shaft extension 326 coupled therewith, as indicated at 816. As the shaft extension 326 is raised, the RCD 302 coupled therewith by friction of its sealing element may also be raised. Accordingly, the RCD 302 may be raised along with the shaft 324, the shaft extension 326, and the top drive 310.

As indicated at 818 and illustrated in FIG. 3B, the top drive 310 may be raised with the shaft extension 326 such that the RCD 302 is moved upwards (due to friction with the shaft extension 326) and disposed or positioned above the rig floor 358. As the top drive 310 is raised, the BOP annular 350 may be closed, if not previously closed, to seal the BOP 340 and/or the wellhead 342, as illustrated in FIG. 3B. The method 800 may include detachably coupling the drag device 304 with the RCD 302 after the RCD 302 is positioned at or above the rig floor 358, as indicated at 820. As previously discussed with reference to FIGS. 5A and 5B, the drag device 304 may be coupled with the RCD 302 by actuating the piston 524 and the finger 520 coupled therewith in the lateral direction toward the finger slot 410 (see FIG. 4) of the RCD 302. The winches 508, 510 may be set to allow the drag device 304 to follow the RCD 302 freely. The method 800 may further include raising the top drive 310 with the shaft extension 326 and consequently the RCD 302 (due to friction) associated with the drag device 304 as indicated at 822 and illustrated at FIG. 3B. Raising the shaft extension 326 with the top drive 310 may provide space between the rig floor 358 and the shaft extension 326 to thereby allow the shaft extension 326 to receive one or more new or additional tubulars (one is shown: 360).

The additional tubular 360 may be coupled with the shaft extension 326, as indicated at 824 and illustrated in FIG. 3C. The additional tubular 360 may be added to the shaft extension 326 via a pipe handler (not shown). After the additional tubular 360 is added, the RCD 302 may be disengaged from the shaft extension 326, as indicated at 826. As indicated at 828 and illustrated in FIG. 3C, the drag device 304 and the RCD 302 coupled therewith may be lowered toward the rig floor 358 by using the winches 508, 510. For example, the upper and lower winches 508, 510 may be actuated to lower the drag device 304 and the RCD 302 coupled therewith toward the rig floor 358. After the drag device 304 and the RCD 302 coupled therewith are lowered toward the rig floor 358, the RCD 302 may engage the additional tubulars 360, as indicated at 830. For example, as illustrated in FIG. 3C, the RCD 302 may engage the additional tubular 360 proximal a lower connection 362 (e.g., a pin end) thereof.

After engaging the RCD 302 proximal the lower connection 362 of the additional tubular 360, the drag device 304 may be disengaged from the RCD 302, as indicated at 832. The method 800 may also include lowering the top drive 310 such that the additional tubular 360 and the RCD 302 coupled therewith may be positioned below the rig floor 358, as indicated at 834. The RCD 302 coupled with the additional tubular 360 may be recoupled with the BOP 340 to thereby seal the BOP 340, as indicated at 836. The method 800 may include opening the second valve 384 to equalize the pressure across the BOP annular 350, as indicated at 838. The method 800 may further include opening the BOP annular 350 after the pressure across the BOP annular 350 is equalized or substantially equalized, as indicated at 840. Then the first valve 382 may be closed, as shown at 842.

The additional tubular 360 may then be lowered such that the lower connection 362 (e.g., the pin end) approaches and/or engages the drill string 322 supported within the BOP 340, as indicated at 844. The additional tubular 360 may then be coupled with the drill string 322 by rotating the new tubular 360 and applying torque via the top drive 310, as indicated at 846. The method 800 may also include opening the third valve 386 to balance the pressure across the pipe ram 352, as shown at 848. The pipe ram 352 and/or the tubular lock 354 may be opened or disengaged from the drill string 322, as shown at 850. The drill string 322 including the additional tubular 360 may then be advanced or lowered further into the wellbore 306, as indicated at 852. The method 800 may then include determining whether another tubular is to be added, as at 854. If another tubular is to be added, the method 800 may return to block 806. Otherwise, the method 800 may end and subsequent tasks (e.g., continued pumping, drilling, etc.) may be performed.

Figure 9:
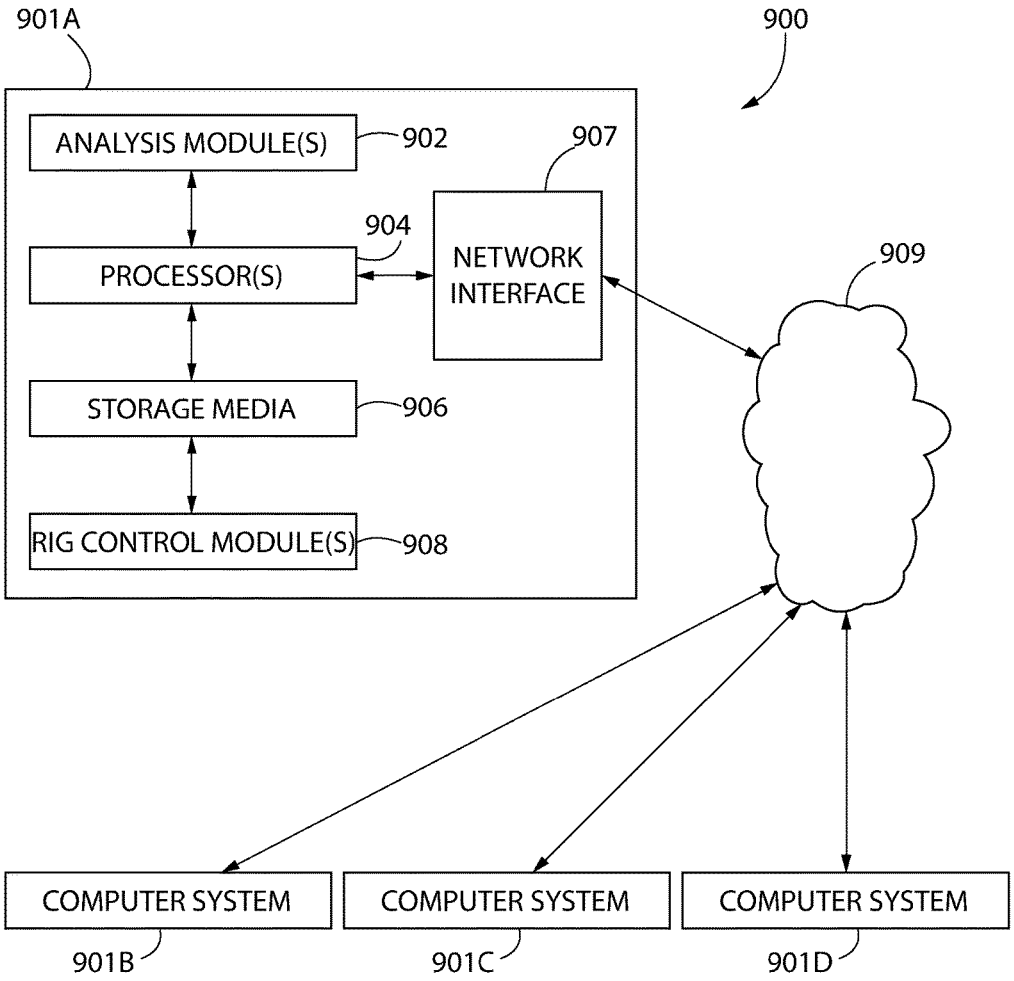
FIG. 9 illustrates a schematic view of a computing system, according to an embodiment.

In some embodiments, the methods of the present disclosure may be executed by a computing system. FIG. 9 illustrates an example of such a computing system 900, in accordance with some embodiments. The computing system 900 may include a computer or computer system 901A, which may be an individual computer system 901A or an arrangement of distributed computer systems. The computer system 901A includes one or more analysis modules 902 that are configured to perform various tasks according to some embodiments, such as one or more methods disclosed herein. To perform these various tasks, the analysis module 902 executes independently, or in coordination with, one or more processors 904, which is (or are) connected to one or more storage media 906. The processor(s) 904 is (or are) also connected to a network interface 907 to allow the computer system 901A to communicate over a data network 909 with one or more additional computer systems and/or computing systems, such as 901B, 901C, and/or 901D (note that computer systems 901B, 901C and/or 901D may or may not share the same architecture as computer system 901A, and may be located in different physical locations, e.g., computer systems 901A and 901B may be located in a processing facility, while in communication with one or more computer systems such as 901C and/or 901D that are located in one or more data centers, and/or located in varying countries on different continents).

A processor may include a microprocessor, microcontroller, processor module or subsystem, programmable integrated circuit, programmable gate array, or another control or computing device.

The storage media 906 may be implemented as one or more computer-readable or machine-readable storage media. Note that while in the example embodiment of FIG. 8 storage media 906 is depicted as within computer system 901A, in some embodiments, storage media 906 may be distributed within and/or across multiple internal and/or external enclosures of computing system 901A and/or additional computing systems. Storage media 906 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 900 contains one or more rig control module(s) 908. In the example of computing system 900, computer system 901A includes the rig control module 908. In some embodiments, a single mixer control module may be used to perform some or all aspects of one or more embodiments of the methods disclosed herein. In alternate embodiments, a plurality of mixer control modules may be used to perform some or all aspects of methods herein.

It should be appreciated that computing system 900 is only one example of a computing system, and that computing system 900 may have more or fewer components than shown, may combine additional components not depicted in the example embodiment of FIG. 8, and/or computing system 900 may have a different configuration or arrangement of the components depicted in FIG. 8. The various components shown in FIG. 8 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A method for continuous mud circulation during a drilling operation, comprising:

delivering a first flow of drilling mud to and through a blowout preventer via a drill string and a wellbore;

delivering a second flow of drilling mud to and through the blowout preventer, wherein the second flow is delivered to the blowout preventer through an alternative line and not via the drill string;

stopping the first flow of the drilling mud;

adding or removing a tubular to or from the drill string after the first flow of drilling mud is stopped and while continuously delivering the second flow of drilling mud, wherein adding or removing the tubular comprises:

decoupling a rotating control device from the blowout preventer;

detachably coupling the rotating control device with a drag device;

wherein detachably coupling the rotating control device with the drag device comprises detachably coupling a finger of the drag device with the rotating control device; and raising or lowering the rotating control device with the drag device coupled therewith.

2. The method of claim 1, wherein detachably coupling the finger with the rotating control device comprises moving the finger laterally toward the rotating control device.

3. The method of claim 2, wherein moving the finger comprises applying a biasing force to the finger using a piston configured to receive hydraulic fluid.

4. A method for continuous mud circulation during a drilling operation, comprising:

delivering a first flow of drilling mud to and through a blowout preventer via a drill string and a wellbore;

delivering a second flow of drilling mud to and through the blowout preventer, wherein the second flow is delivered to the blowout preventer through an alternative line and not via the drill string;

stopping the first flow of the drilling mud;

adding or removing a tubular to or from the drill string after the first flow of drilling mud is stopped and while continuously delivering the second flow of drilling mud, wherein adding or removing the tubular comprises:

decoupling a rotating control device from the blowout preventer;

detachably coupling the rotating control device with a drag device; and raising or lowering the rotating control device with the drag device coupled therewith;

wherein adding the tubular to the drill string comprises:

raising the rotating control device above a rig floor;

sealingly engaging the rotating control device with the tubular above the rig floor; and lowering the rotating control device toward the rig floor using the drag device, wherein the rotating control device is detachably coupled with the drag device above the rig floor; and wherein adding the tubular further comprises:

decoupling the drag device from the rotating control device;

positioning the tubular and the rotating control device below the rig floor after decoupling the drag device from the rotating control device; and coupling the rotating control device with the blowout preventer.

5. A method for continuous mud circulation during a drilling operation, comprising:

delivering a first flow of drilling mud to and through a blowout preventer via a drill string and a wellbore;

delivering a second flow of drilling mud to and through the blowout preventer, wherein the second flow is delivered to the blowout preventer through an alternative line and not via the drill string;

stopping the first flow of the drilling mud;

adding or removing a tubular to or from the drill string after the first flow of drilling mud is stopped and while continuously delivering the second flow of drilling mud, wherein adding or removing the tubular comprises:

decoupling a rotating control device from the blowout preventer;

detachably coupling the rotating control device with a drag device; and raising or lowering the rotating control device with the drag device coupled therewith, wherein removing the tubular from the drill string comprises:

sealingly engaging the rotating control device with the tubular coupled with the drill string before decoupling the rotating control device from the blowout preventer;

positioning a connection between the tubular and the drill string between the rotating control device and a tubular lock of the blowout preventer;

engaging the tubular lock to supporting the drill string in the wellbore;

engaging a pipe ram to seal an annulus defined between the blowout preventer and the drill string; and breaking a connection between the tubular and the drill string.

6. The method of claim 5, wherein removing the tubular from the drill string further comprises engaging an annular seal of the blowout preventer before decoupling the rotating control device from the blowout preventer, wherein a lower end of the tubular is moved between the annular seal and the rotating control device prior to engaging the annular seal.

7. A system for a drilling operation, comprising:

a blowout preventer disposed above a wellbore and receiving a drill string therethrough;

a rotating control device detachably coupled with the blowout preventer, and further receiving and sealingly engaging a tubular of the drill string;

a drag device detachably coupled with the rotating control device when the rotating control device is decoupled from the blowout preventer, and further raising and lowering the rotating control device; and a drilling device in fluid communication with an inner bore of the drill string and at least partially raises and lowers the drill string through the blowout preventer and the rotating control device, wherein the rotating control device comprises:

a slide seal disposed radially outward of the tubular, and sealingly engaging the tubular; and a seal retainer disposed radially outward of the slide seal and defining an annular slot detachably coupled with the drag device.

8. The system of claim 7, wherein the rotating control device further comprises:

a rotating body coupled with the seal retainer; and a non-rotating body disposed radially outward of and rotatably coupled with the rotating body.

9. A system for a drilling operation, comprising:

a blowout preventer disposed above a wellbore and receiving a drill string therethrough;

a rotating control device detachably coupled with the blowout preventer, and further receiving and sealingly engaging a tubular of the drill string;

a drag device detachably coupled with the rotating control device when the rotating control device is decoupled from the blowout preventer, and further raising and lowering the rotating control device; and a drilling device in fluid communication with an inner bore of the drill string and at least partially raises and lowers the drill string through the blowout preventer and the rotating control device, wherein the drag device raises and lowers the rotating control device above a rig floor and along a vertical guide wherein the drag device comprises:

a drag body defining a through-hole and a chamber, the through-hole receives the vertical guide; and a finger assembly slidably disposed in the chamber and engages and detachably couples with the rotating control device.

* * * * *